US006214778B1

(12) United States Patent
Todd

(10) Patent No.: US 6,214,778 B1
(45) Date of Patent: Apr. 10, 2001

(54) POLYUREA-THICKENED GREASE COMPOSITION

(75) Inventor: Patricia R. Todd, Chardon, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 09/634,303

(22) Filed: Aug. 8, 2000

Related U.S. Application Data

(63) Continuation-in-part of application No. 08/989,055, filed on Dec. 11, 1997, which is a continuation-in-part of application No. 08/653,549, filed on May 24, 1996, now abandoned, which is a continuation-in-part of application No. 08/518,775, filed on Aug. 24, 1995, now abandoned.

(51) Int. Cl.[7] ..... C10M 129/26
(52) U.S. Cl. ..... 508/518; 508/526; 508/539
(58) Field of Search ..... 508/518, 526, 508/539

(56) References Cited

U.S. PATENT DOCUMENTS

| | | | |
|---|---|---|---|
| 2,933,520 | 4/1960 | Bader | 260/473 |
| 3,133,944 | 5/1964 | Christenson | 260/434 |
| 3,660,288 | 5/1972 | Hansen | 252/40.7 |
| 3,711,407 | 1/1973 | Plumstead | 252/41 |
| 3,846,314 | 11/1974 | Dreher | 252/18 |
| 3,846,315 | 11/1974 | Stanton | 252/18 |
| 3,868,329 | 2/1975 | Brown et al. | 252/17 |
| 3,983,041 | 9/1976 | Abbott | 252/17 |
| 4,719,023 | 1/1988 | MacPhall | 252/39 |
| 4,828,733 | 5/1989 | Farng et al. | 252/42.7 |
| 4,929,369 | 5/1990 | Tury | 252/12 |
| 5,011,617 | 4/1991 | Fagan | 252/18 |
| 5,084,193 | 1/1992 | Waynick | 252/18 |
| 5,158,694 * | 10/1992 | Waynick | 508/163 |
| 5,207,935 | 5/1993 | Waynick | 252/18 |
| 5,246,605 | 9/1993 | Vartanian | 252/25 |
| 5,256,320 * | 10/1993 | Todd | 508/398 |
| 5,356,546 | 10/1994 | Blystone et al. | 252/35 |

FOREIGN PATENT DOCUMENTS

| | | |
|---|---|---|
| 1052890 | 7/1991 | (CN) . |
| 1052891 | 7/1991 | (CN) . |
| 84910 | 8/1983 | (EP) . |
| 151825 | 10/1985 | (EP) . |
| 508115 * | 10/1992 | (EP) . |
| 566326 | 10/1993 | (EP) . |
| 2215346 | 9/1989 | (GB) . |
| 57-212297 | 12/1982 | (JP) . |
| 3035091 | 2/1991 | (JP) . |
| 924089 | 4/1982 | (SU) . |

* cited by examiner

*Primary Examiner*—Margaret Medley
*Assistant Examiner*—Cephia D. Toomer
(74) *Attorney, Agent, or Firm*—Teresan W. Gilbert; Michael E. Esposito

(57) ABSTRACT

A grease composition comprising a major amount of an oil of lubricating viscosity; a thickener selected from the group consisting of monoureas, diureas, triureas and polyureas, or mixtures thereof; and an oil soluble neutral or overbased zinc salt of a carboxylic acid selected from the group consisting of zinc salts of fatty acids, the zinc salts of hydrocarbyl-substituted salicylic acids, and zinc glyoxylates is disclosed.

24 Claims, No Drawings

POLYUREA-THICKENED GREASE COMPOSITION

This is a continuation-in-part application filed herewith of application Ser. No. 08/989,055 filed Dec. 11, 1997, which is a continuation in part of application Ser. No. 08/653,549, filed May 24, 1996, now abandoned, which is a continuation in part of application Ser. No. 08/518,775 filed Aug. 24, 1995 now abandoned.

This invention relates to a urea-thickened grease composition. More particularly, it relates to a urea-thickened grease composition containing oil-soluble zinc carboxylates.

BACKGROUND OF THE INVENTION

Grease compositions have been known for a long time. Classically, greases have contained an oil of lubricating viscosity and a thickening agent. Thickening agents have often been soaps, such as the metallic salts of fatty acids. Calcium soaps, as grease-thickening agents, have a long history. More recently, complex greases have been developed which use a combination of a salt of a long chain acid, such as stearic acid, and a salt of a short chain acid, such as acetic acid to form a thickening metallic salt soap. Calcium is typical metallic counter ion for this type of grease. Sodium, lithium, and aluminum have been used to form soaps, which act as grease thickeners. Organophilic bentonite clays have been used as grease thickeners. More recently, ureas have been used as grease thickeners. The ureas are prepared by reacting an isocyanate with an amine. Monoureas may be prepared by reacting a monoisocyanate with a monoamine. Polyureas are prepared by reacting combinations of diamines, monoamines, diisocyanates, and monoisocyanates. A common reaction mixture includes a diisocyanate, a diamine and a monoamine. The monoamine is included in the reaction mixture since it acts to terminate the polymer chain and prevents it from becoming too long. The basic reaction is illustrated by the following equation:

$$2MA+2DI+DA \rightarrow MA\text{-}DI\text{-}DA\text{-}DI\text{-}MA \qquad \text{Tetraurea}$$

MA=Monoamine

DI=Diisocyanate

DA=Diamine.

Additives are frequently added to grease to improve various performance properties. Among the properties which may be improved through the use of additives are oxidation stability, water resistance, rust protection, corrosion protection, antiwear, extreme pressure, adhesiveness, color, oil separation, low temperature flow, and high temperature performance. Salicylates have been used in grease compositions, some times as part of a complex grease, and some times as additives.

Chinese Patents 1052890 and 1052891, as abstracted in the Derwent Database under the numbers WPI ACC NO 92-124047/16 and 92-124048/16, disclose lubricating greases containing a thickening agent which includes lithium 12-hydroxy-stearate and lithium salicylate. The salicylate appears to be an unsubstituted salicylate and is said to be part of the thickening agent.

U.S. Pat. No. 3,660,288 discloses a polyurea grease containing the magnesium salts of unsaturated fatty acids. The alkali metal, other alkaline earth metal and zinc salts of an unsaturated fatty acid were tested in the composition, but did not impart the desired rust resistance.

U.S. Pat. No. 3,711,407 discloses a grease composition containing an alkali metal salt of hydroxybenzoic acid. The salt is oil insoluble and forms in small particles evenly distributed throughout the composition.

U.S. Pat. No. 3,846,314 discloses a polyurea grease composition containing an alkaline earth aliphatic carboxylate, especially calcium acetate.

U.S. Pat. No. 3,846,315 discloses polyurea greases containing alkaline earth metal 1–3 carbon monocarboxylates.

U.S. Pat. No. 3,868,329 discloses a polyurea grease composition containing an alkaline earth metal aliphatic monocarboxylate containing from 1 to 3 carbon atoms. Calcium acetate is preferred. The composition also includes a Mannich base.

U.S. Pat. No. 3,983,041 discloses a polyurea grease, which contains an alkaline earth carbonate or an alkaline earth lower carboxylate. The alkaline earth salts serve as rust inhibitors.

U.S. Pat. No. 4,246,605 discloses a polyurea grease containing antimony dipentyldithiocarbamate. The antimony salt provides extreme pressure and antiwear properties to the grease.

U.S. Pat. No. 4,719,023 discloses a grease composition that comprises a base fluid, a thickener, a calcium salicylate and a magnesium salicylate. The salicylates may be neutral but are preferably overbased alkyl salicylates. The calcium salicylate improves anti-rust properties, and the magnesium salicylate counteracts the decrease in dropping point caused by the addition of the calcium salicylate. The thickener may be a substituted urea; however, the preferred thickening agent is an alkali fatty acid soap.

U.S. Pat. No. 4,828,733 discloses greases containing the cuprous salt of 4-hydroxybenzoic acid (salicylic acid is 2-hydroxybenzoic acid). The salts are primarily antioxidants. However, friction-reducing and wear protection are also disclosed.

U.S. Pat. No. 4,929,369 discloses a grease that may be thickened with polyurea and that includes a monovalent salt of a carboxylic acid in which the —COOH group is attached to a ring atom of a fused ring system.

U.S. Pat. No. 5,011,617 discloses a polyurea-thickened grease and an alkaline earth salt of a 1–3 carbon aliphatic monocarboxylate.

U.S. Pat. No. 5,084,193 discloses a polyurea grease that contains, in addition, a simple or complex calcium soap as a further thickener.

U.S. Pat. No. 5,207,935 discloses a polyurea grease containing a calcium, barium, magnesium or zinc salt of an alkylsuccinic acid, such as dodecenylsuccinic acid in combination with a sulfonate. The succinic salt acts as a rust inhibitor and texture improver.

Japanese Patent 3035091 discloses greases thickened with lithium and sodium soaps which include a wide variety of anti-static agents including magnesium oleate, copper oleate and chromium alkylsalicylate.

Japanese Patent 57212297 discloses a lithium grease that includes alkaline earth salicylates.

British Patent 2,215,346 discloses grease compositions thickened with lithium soap, lithium borate, lithium hydroxy-benzoate and a polyol. The lithium hydroxy-benzoate is either the lithium salt of a hydroxy-benzoic acid or the lithium salt of a low alcohol ester of such an acid.

EP Patent 84,910 discloses a lithium complex grease composition that includes lithium salicylate as a complexing agent.

EP Patent 151,825 discloses a continuous process for manufacturing lubricating greases in which the thickener is a soap and various complexing agents, such as acetic and salicylic acid, may be added.

EP Patent 566,326 discloses a polyurea grease with molybdenum dialkyldithiophosphates and ashless dithiophosphates as additives.

Soviet Patent SU 924089 discloses a grease containing a high ash calcium alkylsalicylate. The calcium alkylsalicylate prevents stratification.

U.S. Pat. No. 2,933,520 to Bader relates to compounds represented by the formula:

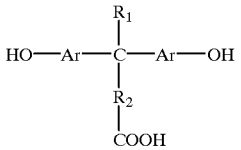

in which $R_1$ may be hydrocarbon, halogen, such as chlorine or the like, and $R_2$ is hydrocarbon, e.g., alkylene, other than methylene, containing at least two carbon atoms such as ethyl, propyl, butyl, with either normal, or branched chains and containing, for example, up to 10, 12 or even more carbon atoms. The Ar groups are aromatic rings. They may be unsubstituted, but one or both thereof can contain substitutents such as alkyl (methyl, ethyl, propyl, butyl, isopropyl, isobutyl), halogen, (chlorine, bromine), nitro, sulfo and others. The nature of each of these groups affecting properties such as boiling point, solubility, toxicity, and bactericidal, fungicidal, insecticidal and like properties.

U.S. Pat. No. 3,133,944 to Christensen teaches heavy metal salts represented by:

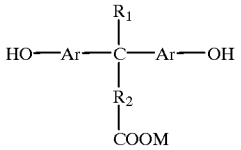

wherein the $R_1$ is an alkyl of 1–4 carbons, $R_2$ is an alkylene of 2–6 carbons and Ar is an aromatic group that may be substituted with one or more methyl groups and others. The salts are said to be adapted to retard or prevent the growth of biological organisms, particularly molds and mildews.

U.S. Pat. No. 5,356,546 relates to metal salts of the general formula:

$$A^{y-}M^{y+} \quad (I)$$

wherein M represents one or more metal ions, y is the total valence of all M, and A presents one or more anion containing groups having a total of about y individual anionic moieties and each anion containing group is a group of the formula:

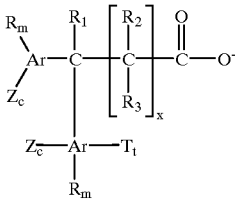

wherein T is an organic group acted from a group of structures, t is 0 or 1, R is an alkyl, alkenyl or aryl group containing at least 8 carbon atoms, $R_1$, $R_2$, and $R_3$ are independently H or a hydrocarbyl group, m is an integer from 1 to 10, c is an integer such that the sum of m, c and t does not exceed the valence capacity of Ar, and Z is OH, $OR_4$ or $O^-$. The salts find utility in lubricants and fuels compositions.

SUMMARY OF THE INVENTION

A grease composition comprising: a major amount of an oil of lubricating viscosity; (A) a thickener selected from the group consisting of monoureas, diureas, triureas and polyureas, or mixtures thereof; and (B) an oil soluble neutral or overbased zinc salt of a carboxylic acid selected from the group consisting of zinc salts of fatty acids, the zinc salts of hydrocarbyl-substituted salicylic acids, and zinc glyoxylates is disclosed. Provided that if (B) is the zinc salt of a fatty acid, the fatty acid does not include ricinoleic acid. The grease composition does not contain boron nitride powders the grease composition does not contain boron nitride powders.

DETAILED DESCRIPTION OF THE INVENTION

Surprisingly, it has been found that the oil-soluble zinc carboxylates act as antiwear additives in urea-thickened greases. The preferred oil-soluble zinc carboxylates are the salts of fatty acids, the salts of hydrocarbyl-substituted salicylic acids, and the salts of the reaction product of glyoxylic acid and hydrocarbyl substituted phenols, herein referred to as zinc glyoxylates. The term zinc glyoxylates is used describe the zinc salts of the bis (hydrocarbyl-substituted hydroxyaryl) acetic acids produced in the reaction between the glyoxylic acid and a phenol.

As will be set forth more fully below, the zinc carboxylates are neutral, to moderately overbased, and the urea greases may be thickened monourea, diurea, triurea, or polyurea thickeners. Moderately over based means a conversion of between 100 and 200.

The term "hydrocarbyl" is used herein to include:

(1) hydrocarbyl groups, that is, aliphatic (e.g., alkyl or alkenyl), alicyclic (e.g., cycloalkyl, cycloalkenyl), aromatic, aliphatic- and alicyclic-substituted aromatic groups and the like as well as cyclic groups wherein the ring is completed through another portion of the molecule (that is, any two indicated groups may together form an alicyclic group);

(2) substituted hydrocarbyl groups, that is, those groups containing non-hydrocarbon groups that, in the context of this invention, do not alter the predominantly hydrocarbyl nature of the hydrocarbyl group; those skilled in the art will be aware of such groups, examples of which include ether, oxo, halo (e.g., chloro and fluoro), alkoxyl, mercapto, alkylmercapto, nitro, nitroso, sulfoxy, etc.;

(3) hetero groups, that is, groups that, while having predominantly hydrocarbyl character within the context of this invention, contain other than carbon in a ring or chain otherwise composed of carbon atoms. Suitable heteroatomns will be apparent to those of skill in the art and include, for example, sulfur, oxygen, nitrogen and such substituents as pyridyl, furanyl, thiophenyl, imidazolyl, etc.

In general, no more than about three nonhydrocarbon groups or heteroatoms, and preferably no more than one, will be present for each ten carbon atoms in a hydrocarbyl group. Typically, there will be no such groups or heteroatoms in a hydrocarbyl group and it will, therefore, be purely hydrocarbyl.

The hydrocarbyl groups are preferably free from acetylenic unsaturation; ethylenic unsaturation, when present, will generally be such that there is no more than one ethylenic linkage present for every ten carbon-to-carbon bonds. The hydrocarbyl groups are often completely saturated and therefore contain no ethylenic unsaturation.

Overbased salts of organic acids are widely known to those of skill in the art and generally include metal salts wherein the amount of metal present in them exceeds the stoichiometric amount. Such salts are said to have conversion levels in excess of 100 (i.e., they comprise more than 100% of the theoretical amount of metal needed to convert the acid to its "normal" or "neutral" salt). Such salts are often said to have metal ratios in excess of one (i.e., the ratio of equivalents of metal to equivalents of organic acid present in the salt is greater than that required to provide the normal or neutral salt which required only a stoichiometric ratio of 1:1). They are commonly referred to as overbased, hyperbased or superbased salts. The zinc salts useful in the present invention are moderately overbased, that is, they have a conversion between 100 and 200.

The terminology "metal ratio" is used in the prior art and herein to designate the ratio of the total chemical equivalents of the metal in the overbased salt to the chemical equivalents of the metal in the salt which would be expected to result in the reaction between the organic acid to be overbased and the basically-reacting metal compound according to the known chemical reactivity and stoichiometry of the two reactants. Thus, in a normal or neutral salt the metal ratio is one, and in an overbased salt the metal ratio is greater than one.

A. UREA GREASE THICKENERS

The greases used in the present invention are thickened with various substituted ureas. The ureas are mono-, di-, tri- or polyureas. The mono-, di-, tri- or polyurea component of this invention is a water and oil insoluble organic compound having a molecular weight between about 375 and 3,400 and having at least one ureido group and preferably between about 2 and 8 ureido groups. A ureido group as referred to herein is defined as

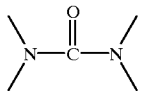

I. A diisocyanate having the formula: OCN—R—NCO wherein R is a hydrocarbylene having from 2 to 30 carbons and preferably from 6 to 15 carbons and more preferably 7 carbons.

II. A polyamine having a total of 2 to 40 carbons and having the formula:

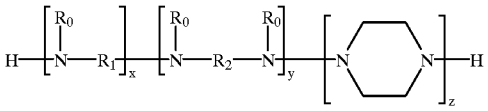

wherein $R_1$ and $R_2$ are the same or different type of hydrocarbylenes having from 1 to 30 carbons and preferably from 2 to 10 carbons and more preferably from 2 to 4 carbons;

$R_0$ is selected from hydrogen or a $C_1$–$C_4$ alkyl and preferably hydrogen;

x is an integer from 0 to 4;

y is 0 or 1; and z is an integer equal to 0 when y is 1 and equal to 1 when y is 0.

III. A monofunctional compound selected from the group consisting of monoisocyanate having 1 to 30 carbons, preferably from 10 to 24 carbons, a monoamine having from 1 to 30 carbons preferably from 10 to 24 carbons, and mixtures thereof.

The reaction can be conducted by contacting the three reactants in a suitable reaction vessel at a temperature between about 60 to 320° F. (16 to 169° C.), preferably from 100 to 300° F. (38 to 149° C.) for a period from 0.5 to 5 hours and preferably from 1 to 3 hours. The molar ratio of the reactants present usually varies from 0.1–2 moles of monoamine or monoisocyanate and 0–2 moles of polyamine for each mole of diisocyanate. When the monoamine is employed, the molar quantities are preferably (n+1) moles of diisocyanate, (n) moles of diamine and 2 moles of monoamine. When the monoisocyanate is employed, the molar quantities are preferably (n) moles of diisocyanate, (n+1) moles of diamine and 2 moles of monoisocyanate.

A particularly preferred class of mono-, di-, tri- or polyurea compounds has structures defined by the following general formulae:

FORMULA 1

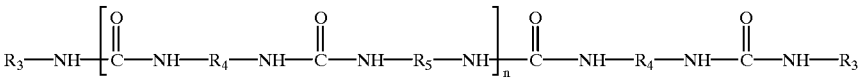

FORMULA 2

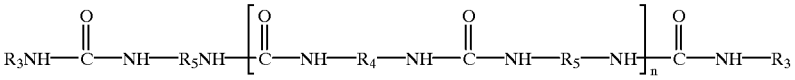

FORMULA 3

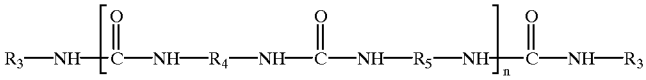

A particularly preferred polyurea compound has an average between 3 and 4 ureido groups and has a molecular weight between about 600 and 1200.

In one embodiment, the mono-, di-, tri- or polyurea compounds are prepared by reacting the following components:

wherein:

n is an integer from 0 to 4;

$R_3$ is the same or different hydrocarbyl having from 1 to 30 carbon atoms, preferably from 10 to 24 carbons;

$R_4$ is the same or different hydrocarbylene having from 2 to 30 carbon atoms, preferably from 6 to 15 carbons; and $R_5$ is the same or different hydrocarbylene having from 1 to 30 carbon atoms, preferably from 2 to 10 carbons.

The hydrocarbylene, as defined in $R_1$ and $R_2$ above, is a divalent hydrocarbon radical which may be aliphatic, alicyclic, aromatic or combinations thereof, e.g., alkylarylene, aralkylene, alkylcycloalkylene, cycloalkylarylene, etc., having its two free valences on different carbon atoms.

The mono-, di-, tri- or polyureas having the structure presented in Formula 1 above are prepared by reacting (n+1) moles of diisocyanate with two moles of a monoamine and (n) moles of a diamine. (When n equals zero in the above Formula 1, the diamine is deleted.) Mono-, di-, tri- or polyureas having the structure presented in Formula 2 above are prepared by reacting (n) moles of a diisocyanate with (n+1) moles of a diamine and two moles of a monoisocyanate. (When n equals zero in the above Formula 2, the diisocyanate is deleted.) Mono-, di-, tri- or polyureas having the structure presented in Formula 3 above are prepared by reacting (n) moles of a diisocyanate with (n) moles of a diamine and one mole of a monoisocyanate and one mole of a monoamine. (When n equals zero in Formula 3, both the diisocyanate and diamine are deleted.)

In preparing the above mono-, di-, tri- or polyureas, the desired reactants (diisocyanate, monoisocyanate, diamine and monoamine) are admixed within a suitable reaction vessel in the proper proportions. The reaction may proceed without the presence of a catalyst and is initiated by merely contacting the component reactants under conditions conducive for the reaction. The reaction itself is exothermic and, accordingly, by initiating the reaction at room temperature, elevated temperatures are obtained. However, external heating or cooling may be desirable.

REACTANTS

The monoamine or monoisocyanate used in the formulation of the mono-, di-, tri- or polyurea will form the terminal end groups. These terminal end groups will have from 1 to 30 carbon atoms, but are preferably from 5 to 28 carbons, and more desirably from 6 to 25 carbon atoms.

Illustrative of various monoamines are pentylamine, hexylamine, heptylamine, octylamine, decylamine, dodecylamine, tetradecylamine, hexadecylamine, octadecylamine, eicosylamine, dodecenylamine, hexadecenylamine, octadecenylamine, octadecadienylamine, abietylamine, aniline, toluidene, naphthylamine, cumylamine, bornylamine, fenchylamine, tertiary butyl aniline, benzylamine, beta-phenethylamine, etc. Particularly preferred amines are prepared from natural fats and oils or fatty acids obtained therefrom. These starting materials can be reacted with ammonia to give first amides and then nitrites. The nitrites are then reduced to amines, conveniently by catalytic hydrogenation. Exemplary amines prepared by the method include stearylamine, laurylamine, palmitylamine, oleylamine, petroselinylamine, linoleylamine, linolenylamine, eleostearylamine, etc. The unsaturated amines are particularly preferred.

Illustrative of monoisocyanates are hexylisocyanate, decylisocyanate, dodecylisocyanate, tetradecylisocyanate, hexadecylisocyanate, phenylisocyanate, cyclohexylisocyanate, xyleneisocyanate, cumeneisocyanate, abietylisocyanate, cyclooctylisocyanate, etc.

The polyamines, which form the internal hydrocarbon bridges between the ureido groups, usually contain from 2 to 40 carbons and preferably from 2 to 30 carbon atoms, more preferably from 2 to 20 carbon atoms. Exemplary polyamines include diamines such as ethylenediamine, propanediamine, butanediamine, hexanediamine, dodecanediamine, octanediamine, hexadecanediamine, cyclohexanediamine, cyclooctanediamine, phenylenediamine, tolylenediamine, xylenediamine, dianiline methane, ditoluidinemethane, bis(aniline), bis(toluidine), piperazine, etc., triamines, such as arninoethyl piperazine, diethylene triamine, dipropylene triamine, N-methyl-diethylene triamine, etc., and higher polyamines such as triethylene tetramine, tetraethylene pentamine, pentaethylene hexarnine, etc.

Representative examples of diisocyanates include hexanediisocyanate, decanediisocyanate, octadecanediisocyanate, phenylenediisocyanate, tolylenediisocyanate, bis(diphenylisocyanate), methylene bis(phenylisocyanate), etc.

Another preferred class of mono-, di-, tri- or polyurea compounds which may be successfully employed in the practice of this invention include the following:

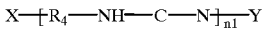

wherein:

$n^1$ is an integer of 0 to 8, $R_4$ is the same or different hydrocarbylene having from 2 to 30 carbon atoms, preferably from 6 to 15 carbons; X and Y are monovalent radicals selected from TABLE I below.

TABLE I

| X | Y |
|---|---|
| 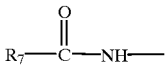 | 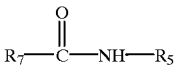 |
| 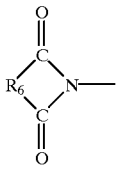 | 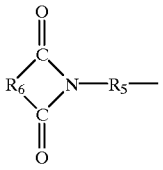 |
| | $R_8$— |

In the Table, $R_5$ is the same or different hydrocarbylene having from 1 to 30 carbon atoms, preferably from 2 to 10 carbons; $R_8$ is the same or different hydrocarbyl having from 1 to 30 carbon atoms, preferably from 10 to 24 carbons; $R_6$ is selected from the group consisting of arylene radicals of 6 to 16 carbon atoms and alkylene groups of 2 to 30 carbon atoms, and $R_7$ is selected from the group consisting of alkyl radicals having from 10 to 30 carbon atoms and aryl radicals having from 6 to 16 carbon atoms.

Tolylene polyurea-thickened greases, wherein at least one $R_4$, in the following formula, is tolylene are well known.

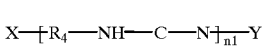

By tolylene it is meant a divalent organic radical having its two free valences on different carbon atoms of a methylbenzene moiety. For example, "2,4-tolylene" refers to:

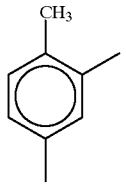

The mono-, di-, tri- or polyurea compounds are prepared by blending the several reactants together in a suitable reaction vessel and heating them to a temperature ranging from 70° F. to 400° F. for a period sufficient to cause formation of the compound, generally from 5 minutes to 1 hour. The reactants can be added all at once or sequentially.

Examples of suitable diisocyanates, monoisocyanates, monoamines and polyamines are described supra.

The mono-, di-, tri- or polyurea compounds are generally mixtures of compounds having structures wherein $n^1$ varies from 0 to 4, or $n^1$ varies from 1 to 3, existent within the grease composition at the same time. For example, when a monoamine, a duisocyanate and a diamine are concurrently present within the reaction zone, as in the preparation of mono-, di-, tri- or polyureas having the structure shown in Formula 2, some of the monoamine may react with both sides of the duisocyanate to form a diurea. In addition to the formulation of diurea, simultaneous reactions can be ccurring to form the tri-, tetra-, penta-, hexa-, octa-, etc., ureas. Particularly good results have been realized when the polyurea compound has an average of four ureido groups.

The amount of mono-, di-, tri- or polyurea compound in the final grease composition will be sufficient to thicken the base oil to the consistency of grease when combined with the alkaline earth metal carboxylate. Generally, the amount of mono-, di,-tri- or polyurea will range from 1 to 15 weight percent and preferably from 2 to 7 weight percent of the final grease composition.

The polyureas of the above formula are readily prepared by mixing diamines and diisocyanates with monoisocyanates or monoamines in the proper proportions to form the desired polyurea. The greases thickened with the polyureas are useful at temperatures from about 100° F. to 500° F. They are stable and remain oily after long use, not becoming hard or brittle. The grease compositions thus formed are extremely resistant to emulsification in water.

B. ANTIWEAR ADDITIVES

As set forth below, the antiwear additives of the present invention are oil soluble, neutral or overbased zinc carboxylates.

Zinc Hydrocarbyl Salicylate

The zinc hydrocarbyl salicylate may be symbolized by the following formula:

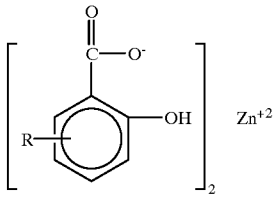

wherein R is a hydrocarbyl group containing from about 7 to about 40 carbon atoms. The R group may be any hydrocarbyl group; however, alkyl groups containing from 7 to 40 carbon atoms are preferred. Alkyl groups containing about 7 to about 24 carbon atoms are more preferred, and alkyl groups containing about 12 to about 18 carbon atoms are most preferred. The zinc salts may be neutral, and may be prepared from neutral sodium hydrocarbyl salicylates by metal exchange. In this method of preparation, the sodium salicylate is treated with a zinc salt, such as zinc chloride, to give the desired zinc salt. In another method of preparation, an alkali metal phenate along with an excess of an alkali metal hydroxide is treated with carbon dioxide. The product is an overbased salicylate of up to 200 conversion. When this salt is treated with zinc, an overbased zinc salicylate is produced.

Zinc Fatty Acid Carboxylates

The essential feature of the carboxylates used in this invention is that they are oil-soluble. The zinc salts of short chain fatty acids, such as acetic, proprionic and butyric, are not sufficiently oil soluble to be usable in the compositions of the present invention. The salts of fatty acids containing 8 or more carbon atoms provide the required degree of oil solubility. Specific examples of usable fatty acids include caprylic acid ($C_8$), capric acid ($C_{10}$), lauric acid ($C_{12}$), myristic acid ($C_{14}$), palmitic acid ($C_{16}$), stearic acid ($C_{18}$), oleic acid (unsaturated $C_{18}$) and linoleic acid (unsaturated $C_{18}$) The oil-soluble neutral or overbased zinc salt of carboxylic acid selected from the group consisting of zinc salts of a fatty acid, the zinc salts of hydrocarbyl-substituted salicylic and zinc glyoxylates providing that the zinc salt of the fatty acid is not ricinoleic acid. The zinc salts may be prepared by forming the sodium salt of the carboxylic acid, and reacting that salt with zinc chloride. This replacement reaction may be conducted at a temperature between 100 and 200° C. Zinc carboxylates may also be prepared by saponification of fats using zinc oxide. Zinc carboxylates may also be prepared by the reaction of zinc oxide with carboxylic acids. The reaction is conducted at a moderately elevated temperature to drive off the water formed during the reaction. The moderately overbased zinc carboxylates may be prepared by methods well known to those skilled in the art.

Zinc Salts of the Reaction Product of Glyoxylic Acid and Hydrocarbyl Phenols

The zinc glyoxylates useful in the present invention are zinc salts of the reaction product of glyoxylic acid and hydrocarbyl substituted phenols. These zinc salts correspond to the following formula:

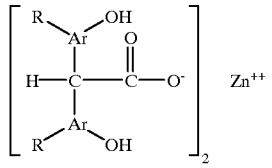

wherein Ar is an aromatic group containing 1 to 3 aromatic rings, R is one or more hydrocarbyl groups containing from about 4 to about 150 carbon atoms provided that the number of R groups shall not exceed the available valences on the aromatic group. It is readily apparent from the formula that the zinc salts are the zinc salts of the bis (hydrocarbyl substituted hydroxyaryl) acetic acids produced in the reaction between the glyoxylic acid and the phenol. The phenols used to prepare these salts generally contain aromatic groups (Ar) having no substituents except for the R groups. However, for reasons of cost, and availability, etc., Ar is normally a benzene nucleus. Most preferably Ar is a benzene nucleus substituted by an R group in a position para to the OH group.

Preferably each R is an aliphatic group containing at least 4 and up to about 150 carbon atoms, frequently from about 4 to about 100 carbon atoms, preferably from about 4 to about 75 carbon atoms. In one embodiment, R contains about 4 to about 50 carbon atoms, and in another embodiment from about 4 to about 24 carbon atoms, R is preferably alkyl or alkenyl, preferably substantially saturated alkenyl. Each R may also be an aliphatic group containing about 7 to about 150 carbon atoms, or from about 7 to about 100 carbon atoms, or from about 7 to about 75 carbon atoms, or from about 7 to about 50 carbon atoms, or from about 7 to about 24 carbon atoms, or from about 12 to about 24 carbon atoms. R is preferably alkyl or alkenyl, preferably substantially saturated alkenyl. In one preferred embodiment, R contains at least 7 carbon atoms, often from 12 to 18 carbons. In another embodiment, each R contains an average of at least 30 carbon atoms, often an average of from about 30 to about 100 carbons. In another embodiment, R contains from 12 to about 50 carbon atoms. In a further embodiment, R contains from about 12 to about 24 carbon atoms and preferably from about 12 to about 18 carbon atoms. For reasons of cost and availability, heptyl, octyl and nonyl-substituted phenols (R=7 to 9) are a preferred embodiment for this application.

The zinc ions may be derived from zinc metal or reactive zinc compounds that will react with carboxylic acids to form carboxylates such as zinc oxide, zinc hydroxide, zinc carbonate, etc.

The zinc glyoxylates (zinc salts of the bis (hydrocarbyl substituted hydroxyaryl) acetic acids) that are useful as antiwear agents in the greases of this invention may be readily prepared by reacting (a) a reactant of the formula $$R_m—Ar—OH$$

wherein R is hydrocarbyl containing about 4 to about 150 carbon atoms, m ranges from 1 to about 10, Ar is an aromatic group containing 1 to 3 rings, and m does not exceed the available valences of Ar after allowing for at least one reaction site for the glyoxylic acid to react;

(b) glyoxylic acid shown below as the hydrate

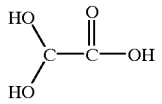

Water of hydration as well as any water generated by the condensation reaction is preferably removed during the course of the reaction.

The reaction is normally conducted in the presence of a strong acid catalyst. Particularly useful catalysts are illustrated by methanesulfonic acid and para-toluenesulfonic acid. The reaction is usually conducted with the removal of water.

Reactants (a) and (b) are preferably present in a molar ratio of about 2:1; however, useful products may be obtained by employing an excess amount of either reactant. Thus, molar ratios of (a):(b) of 1:1, 2:1, 1:2, 3:1, etc. are contemplated and useful products may be obtained thereby. Illustrative examples of reactants (a) include hydroxy aromatic compounds such as phenols, both substituted and unsubstituted within the constraints imposed on Ar hereinabove, and a variety of aromatic hydroxy compounds. In all the above cases, the aromatic groups bearing the phenolic —OH groups may be single ring, fused ring or linked aromatic groups as described in greater detail hereinabove.

Specific illustrative examples of compounds which may be employed as reactant (a) hydrocarbon-substituted phenols such as di-alkyl phenols, naphthol, 2,2'-dihydroxybiphenyl, 4,4-dihydroxybiphenyl, 3-hydroxyanthracene, 1,2,10-anthracenetriol, resorcinol, 2-t-butyl phenol, 4-t-butyl phenol, 2,6-di-t-butyl phenol, 2,4-di-t-butyl phenol, octyl phenol, cresols, di-nonyl phenol, propylene tetramer-substituted phenol, propylene oligomer (Mw 300–800)-substituted phenol, polybutene (number average Mw about 1000)-substituted phenol, substituted-naphthols corresponding to the above exemplified phenols, methylene-bis-phenol, bis-(4-hydroxyphenyl)-2,2-propane, and hydrocarbon-substituted bis-phenols wherein the hydrocarbon substituents have at least 4 carbon atoms, for example, butyl, pentyl, hexyl, octyl, dodecyl, oleyl, polybutenyl.

The method of preparation of numerous alkyl phenols is well known. Illustrative examples of alkyl phenols and related aromatic compounds and methods for preparing same are given in U.S. Pat. No. 4,740,321 to Davis et al. This patent is hereby incorporated herein by reference.

U.S. Pat. No. 2,933,520 (Bader) and U.S. Pat. No. 3,954,808 (Elliott et al) describe procedures for preparing the reaction product of a phenol and glyoxylic acid. These patents are expressly referred to herein for relevant disclosures relating to preparative procedures and methods contained therein.

The intermediate product obtained from the reaction of the foregoing hydroxy aromatic compounds and carboxylic acids is then reacted with a metal containing reactant to form a salt. Suitable metal-containing reactants have been enumerated hereinabove.

The above examples are intended to be illustrative of suitable reactants and are not intended, and should not be viewed as, an exhaustive listing thereof.

The carboxylate salt is formed by reaction of the metal containing reactant with the glyoxylic acid derivative. The preparation of these salts is described in U.S. Pat. No. 5,356,546.

Preparation of Greases

The methods of preparing urea grease thickeners are well known to those skilled in the art. In a typical preparation, grease compositions may be prepared starting with a base oil and the reactants needed to form an urea thickener. For example, mixture of an amine and the oil is warmed, and the appropriate isocyanate or mixture of isocyanates added. Optionally, the isocyanate may be added as an oil solution. The reaction between the amines and the isocyanates proceeds rather rapidly and generates some heat that is controlled by how much heat is applied to the kettle and the rate of addition of isocyanate. Generally, the reaction between the amnines and the isocyanates is conducted at a temperature between about 30 and 70° C. After the urea thickener is formed, a small amount of water is added, and the grease is cooked at a temperature up to about 210° C. The water reacts with any residual diisocyanate. The grease is then cooled, and other desirable additives may be added along with further base oil, if desired. The grease is then milled using an appropriate grease mill to produce the final product. If desired, further additives may be added by reheating the grease and remilling to incorporate these further additives. Variations on this basic process for the formation of urea-thickened greases will be readily apparent to those skilled in the art.

All patents referred to herein are expressly incorporated by reference for their relevant disclosures.

The following specific illustrative Examples describe the preparation of the compounds of Formula (I) useful in the compositions of this invention. In the following examples, as well as in the claims and in the specification of this application, parts are parts by weight, the temperature is degrees Celsius and the pressure is atmospheric, unless otherwise indicated.

As will be readily apparent to those skilled in the art, variations of each of the illustrated reactants and combinations of reactants and conditions may be used.

EXAMPLES

Example A

Preparation of Zinc Salicylate 800 parts of diluent oil were added to a reactor. 180.8 parts of zinc chloride were added with stirring. 200 parts of water was added. The mixture was warmed to a temperature of 90–93° C. over one hour. 1000 parts of the sodium salt of an alkylsalicylate (containing xylene 65 to 75% sodium alkyl salicylate), in which the alkyl group contains between 14 and 18 carbons, was added at a temperature of 91–96° C. The batch was held for 2 hours at this temperature. The batch was heated to 154–160° C., for a period of 6 hours, while nitrogen was bubbled through the batch to remove aqueous and organic materials. Finally the batch was vacuum-stripped at a temperature of 154–160° C. and a pressure of 20 millimeters of mercury. The product was filtered and the filter flushed using approximately 577 parts of diluent oil. Slightly more or less diluent oil may be used to adjust the product to the desired final concentration. The final water content was less than 0.30%. The product contained 30% of the zinc salicylate, and 70% diluent oil.

Example 1

A polyurea grease was prepared by reacting 4,4'-methylene biphenyl diisocyanate with a commercial grade of tall oil amine containing predominantly palmityl amine, stearyl amine, and oleyl amine. The amine and the isocyanate were reacted in the base oil at approximately 200° C. The thickened oil was mixed in a grease mill, and the resulting thickened polyurea grease was set aside as a base stock for use in preparing grease samples.

Six grease compositions were prepared starting with a base grease thickened with a urea thickener (results shown in TABLE 1). The greases were subjected to penetration tests and dropping point tests. In addition, they were subjected to the four-ball wear test to determine a scar diameter, as well as the coefficient of friction. Samples 1 through 5 are not examples of the present invention, but instead were prepared with commonly used grease additives. Samples 1–5 are presented for comparison purposes. Sample 6 was prepared according to the present invention. Sample 1 consisted of the base grease mixed with 1% of an additive formed by reacting $C_{14-18}$-alcohols with $P_2O_5$ followed by salting with alkyl $C_{12-14}$ primary amines. Sample 2 was formed by adding to the base grease 1% of an additive comprising 76.5% of an amine salt of dithiophosphoric acid, 17.5% of dibutylphosphite, and 6% diluent oil. Sample 3 was formed by adding to the base oil 1% of an additive consisting of a calcium overbased sulfonate (TBN=375) and 50% diluent oil. Sample 4 was formed by adding to the base grease 1% of the additive of Sample 2 and 1% of the additive of Sample 3. Sample 5 was prepared by adding to the base 1% of an additive containing 85% borated soybean lecithin and 15% oil. Sample 6 was prepared by adding to the base grease 1% of an additive, prepared in Example A, consisting of 30% of the neutral zinc salt of a $C_{14-18}$ alkyl salicylic acid and 70% diluent oil.

TABLE 1

| | Penetration | | | Dropping Point | Four-ball Wear ASTM D2266 | |
|---|---|---|---|---|---|---|
| Sample ID | UNW | 60 X | 10 K | ° C. | Scar, mm | Coeff. of Friction |
| Polyurea base grease | 299 | 301 | 306 | 209 | .55 | .0907 |
| Example 1 | | | | | | |
| 1 | 315 | 310 | 321 | 206 | .39 | .0335 |
| 2 | 304 | 303 | 300 | 203 | .44 | .0385 |
| 3 | 309 | 308 | 319 | 209 | .44 | .0400 |
| 4 | 313 | 306 | 317 | 203 | .47 | .0465 |
| 5 | 315 | 312 | 311 | 208 | .39 | .0360 |
| 6 | 316 | 311 | 321 | 206 | .36 | .0285 |

UNW is the results for the unworked grease.
60 X is the results for each grease after 60 strokes.
10 K is the results after 10,000 strokes.

Example 2

Further grease samples were prepared by adding zinc oleate as an antiwear agent to a commercial sample of a polyurea grease base. The commercial grease base contained a polyurea thickener similar to that prepared in EXAMPLE 1. The base grease served as a control in the tests of the grease. Grease sample 7 was prepared by adding 2 percent zinc oleate to the base grease. Grease sample 8 was prepared by adding 1 percent zinc oleate to the base grease. Grease sample was prepared by adding 0.5 percent zinc oleate to the base grease. These samples were tested using the four-ball wear test like that used for EXAMPLE 1. The four-ball wear test was used to determine the coefficient of friction and the scar diameter. The results are shown in TABLE 2. Because the four-ball wear tests were performed at different times, the results are comparable to each other but not to the results of EXAMPLE 1.

TABLE 2

| ITEM NO. | CONTROL | 7 | 8 | 9 |
|---|---|---|---|---|
| % WT | | | | |
| Polyurea Base Grease | 100% | 98% | 99% | 99.5% |
| Zinc Oleate | | 2% | 1% | 0.5% |
| ASTM D2266 Four-ball Wear | | | | |
| Hours | 1 | 1 | 1 | 1 |
| Temp, F | 167 | 167 | 167 | 167 |
| RPM | 1200 | 1200 | 1200 | 1200 |
| Weight | 40 Kg | 40 Kg | 40 Kg | 40 Kg |
| Avg. Coeff. of Fric. | 0.076/0.0900 | 0.098/0.091 | 0.06/0.062 | 0.057/0.058 |
| Avg. Scar Diameter/mm | 0.81/0.84 | 0.57/0.54 | 0.48/0.51 | 0.6/0.48 |

Example 3

A zinc glyoxylate (zinc salt of a bis (hydrocarbyl substituted hydroxyaryl) acetic acid) was prepared by reacting 2 moles of dinonyl phenol with 1 mole of glyoxylic acid hydrate in the presence of catalytic quantities of methane sulphonic acid (0.19% by weight). The mixture was vacuum stripped at 110° C. and 35 mm. Hg to remove water. The product was neutralized with potassium hydroxide. The resulting potassium salt was reacted with a stoichiometric amount of zinc chloride to form the zinc glyoxylate. The product contains 60 % neutral zinc glyoxylate, and 40% diluent oil.

Example 4

A further grease sample was prepared by adding the zinc glyoxylate (zinc salt of the bis (hydrocarbyl substituted hydroxyaryl) acetic acid) of EXAMPLE B as an antiwear agent to a commercial sample of a polyurea grease base. The commercial grease base contained a polyurea thickener similar to that prepared in EXAMPLE 1. The base grease served as a control in the tests of the grease. Grease sample 10 was prepared by adding 0.67 percent of the zinc glyoxylate of EXAMPLE 3 (containing 0.4% zinc glyoxylate) to the base grease. The four-ball wear test was used to determine the coefficient of friction and the scar diameter. The results are shown in TABLE 3. Because the four-ball wear tests were performed at different times, the results are comparable to each other, but not to the results of EXAMPLE 1.

TABLE 3

| ITEM NO. | CONTROL | 10 |
|---|---|---|
| % WT | | |
| Polyurea Base Grease | 100% | 99.33% |
| Zinc Glyoxylate (Ex. B) | | 0.67% |
| ASTM D2266 | | |
| Four-ball Wear | | |
| Hours | 1 | 1 |
| Temp, F | 167 | 167 |
| RPM | 1200 | 1200 |
| Weight | 40 Kg | 40 Kg |
| Avg. Coeff. of Friction | 0.076/0.0900 | 0.065 |
| Avg. Scar Diameter/mm | 0.81/0.84 | 0.48 |

What is claimed is:

1. A grease composition comprising a major amount of an oil of lubricating viscosity and an additive further comprising (A) a thickener selected from the group of monoureas, diureas, triureas, and polyureas, and mixtures thereof, and (B) an oil-soluble neutral or overbased zinc salt of a carboxylic acid selected from the group consisting of zinc salts of fatty acids, the zinc salts of hydrocarbyl-substituted salicylic acids, and zinc glyoxylates, provided that if (B) is the zinc salt of a fatty acid, the fatty acid is not ricinoleic acid and wherein the grease compositions does not contain boron nitride powders.

2. A grease composition according to claim 1 wherein the oil-soluble zinc salt comprises an overbased zinc salt.

3. A grease composition according to claim 1 wherein the oil-soluble zinc salt comprises a zinc salt of a hydrocarbyl-substituted salicylic acid corresponding to the following formula:

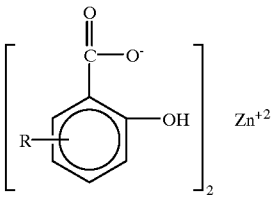

wherein R is a hydrocarbyl group.

4. A grease composition according to claim 3 wherein the oil-soluble zinc salt comprises an overbased zinc salt of a hydrocarbyl-substituted salicylic acid.

5. A grease composition according to claim 3 wherein the R group contains between about 7 and about 40 carbon atoms.

6. A grease composition according to claim 3 wherein the R group contains between about 7 and about 24 carbon atoms.

7. A grease composition according to claim 3 wherein the R group contains between about 12 and about 18 carbon atoms.

8. A grease composition according to claim 1 wherein the oil soluble zinc salt comprises a zinc salt of a fatty acid.

9. A grease composition according to claim 8 wherein the oil soluble zinc salt is selected from group consisting of the zinc salts of caprylic acid, capric acid, lauric acid, myristic acid, palmitic acid, stearic acid, oleic acid, and linoleic acid.

10. A grease composition according to claim 8 wherein the oil soluble zinc salt is the zinc salt of oleic acid.

11. A grease composition according to claim 10 wherein the oil soluble zinc salt is an overbased zinc salt of oleic acid.

12. A grease composition according to claim 1 wherein the oil soluble zinc salt comprises a zinc glyoxylate of the following formula:

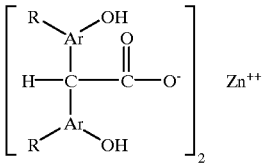

wherein Ar is an aromatic group containing 1 to 3 aromatic rings, R is one or more hydrocarbyl groups containing from about 4 to about 150 carbon atoms provided that the number of R groups shall not exceed the available valences on the aromatic group.

13. A grease composition according to claim 12 wherein R contains about 4 to about 100 carbon atoms.

14. A grease composition according to claim 12 wherein R contains about 4 to about 50 carbon atoms.

15. A grease composition according to claim 12 wherein R contains about 4 to about 24 carbon atoms.

16. A grease composition according to claim 12 wherein R contains about 7 to about 100 carbon atoms.

17. A grease composition according to claim 12 wherein R contains about 7 to about 50 carbon atoms.

18. A grease composition according to claim 12 wherein R contains about 7 to about 24 carbon atoms.

19. A grease composition according to claim 12 wherein R contains about 12 to about 18 carbons atoms.

20. A grease composition according to claim 1 wherein the thickener comprises a monourea.

21. A grease composition according to claim 1 wherein the thickener comprises a diurea.

22. A grease composition according to claim 1 wherein the thickener comprises a triurea.

23. A grease composition according to claim 1 wherein the thickener comprises a polyurea.

24. A method of lubricating metal surfaces that move with respect to each other that comprises placing between said metal surfaces an appropriate quanitity of a grease composition comprising of a major amount of an oil of lubricating viscosity, a thickener selected from the group consisting of monoureas, diureas, triureas and polyureas, or mixtures thereof, and an oil-soluble neutral or overbased zinc salt of a carboxylic acid selected from the group consisting of zinc salts of fatty acids, the zinc salts of hydrocarbyl-substituted salicylic acids, and zinc glyoxylates.

* * * * *